US006190299B1

(12) United States Patent
Simmons

(10) Patent No.: US 6,190,299 B1
(45) Date of Patent: Feb. 20, 2001

(54) CUSHION PRODUCING MACHINE

(75) Inventor: James A. Simmons, Painesville Township, OH (US)

(73) Assignee: Ranpak Corporation, Painesville Township, OH (US)

( * ) Notice: Under 35 U.S.C. 154(b), the term of this patent shall be extended for 0 days.

(21) Appl. No.: 08/410,048

(22) Filed: Mar. 24, 1995

(51) Int. Cl.[7] ..... B31F 1/10
(52) U.S. Cl. ..... 493/464; 493/967
(58) Field of Search ..... 493/185, 967, 493/464

(56) References Cited

U.S. PATENT DOCUMENTS

| | | | |
|---|---|---|---|
| 1,989,794 | 2/1935 | Duvall | 154/54 |
| 2,882,802 | 4/1959 | Walker | 93/1 |
| 3,238,852 | 3/1966 | Schur et al. | 93/1 |
| 3,509,797 | 5/1970 | Johnson | 93/1 |
| 3,603,216 | 9/1971 | Johnson | 93/1 |
| 3,613,522 | 10/1971 | Johnson | 93/1 |
| 3,650,877 | 3/1972 | Johnson | 161/47 |
| 3,655,500 | 4/1972 | Johnson | 93/1 |
| 3,799,039 | 3/1974 | Johnson | 93/1 |
| 3,834,689 * | 9/1974 | Lee et al. | 270/41 |
| 4,026,198 | 5/1977 | Ottaviano | 93/1 |
| 4,085,662 | 4/1978 | Ottaviano | 93/1 |
| 4,109,040 | 8/1978 | Ottaviano | 93/1 |
| 4,237,776 | 12/1980 | Ottaviano | 493/382 |
| 4,557,716 | 12/1985 | Ottaviano | 493/964 |
| 4,717,613 | 1/1988 | Ottaviano | 428/129 |
| 4,750,896 | 6/1988 | Komaronsky et al. | 493/357 |
| 4,839,210 | 6/1989 | Komaronsky et al. | 428/77 |
| 4,884,999 | 12/1989 | Baldacci | 943/439 |
| 4,968,291 | 11/1990 | Baldacci | 443/354 |
| 5,061,543 | 10/1991 | Baldacci | 428/126 |
| 5,123,889 | 6/1992 | Armington et al. | 493/352 |
| 5,188,581 | 2/1993 | Baldacci | 493/381 |
| 5,211,620 | 5/1993 | Ratzel et al. | 493/346 |
| 5,322,477 | 6/1994 | Armington et al. | 493/346 |

* cited by examiner

*Primary Examiner*—Joseph J. Hail, III
(74) *Attorney, Agent, or Firm*—Renner, Otto, Boisselle & Sklar, LLP

(57) ABSTRACT

A cushion producing machine includes a frame, a forming assembly mounted to the frame for creating a cushioning product from sheet-like stock material, the forming assembly including a triangular plate coacting with a pair of curved surfaces to inwardly roll the lateral edges of the stock material to form a continuous strip having lateral pillow-like portions and a thin central band, and a coining assembly for coining the central band of the continuous strip.

24 Claims, 4 Drawing Sheets

CUSHION PRODUCING MACHINE

FIELD OF THE INVENTION

This invention relates generally to a dunnage-creating machine such as a cushion producing machine for producing a dunnage product from sheet-like stock material supplied, for example, in roll form and, more particularly, to forming assemblies for such a machine.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion or cushion producing machine, such as those disclosed in U.S. Pat. Nos. 4,026,198; 4,968,291; and 5,123,889, for example. (These patents are all assigned to the assignee of the present invention and their entire disclosures are hereby incorporated by reference.) Such a cushion producing machine converts sheet-like stock material, such as paper in multi-ply form, into low density cushioning pads or dunnage.

A cushion producing machine, such as one of those disclosed in the above-identified patents, may include a stock supply assembly, a forming assembly, a gear assembly, and a cutting assembly, all of which are mounted on the machine's frame. During operation of such a cushion producing machine, the stock supply assembly supplies the stock material to the forming assembly. The forming assembly typically includes a chute within which is disposed a three-dimensional wire forming frame, the conical body and forming frame causing an inward rolling of the lateral edges of the sheet-like stock material to form a continuous strip having lateral pillow-like portions and a thin central band. The gear assembly, powered by a feed motor, pulls the stock material through the machine and also coins the central band of the continuous strip to form a coined strip. The coined strip travels downstream to the cutting assembly which cuts the coined strip into pads of a desired length.

SUMMARY OF THE INVENTION

The present invention provides an alternative to forming assemblies employing a three-dimensional wire frame disposed within a chute. The invention employs a triangular plate coacting with a pair of curved surfaces, such as would be provided by a hollow conical chute, to form sheet-like stock material into a continuous strip of cushioning product. The triangular plate and chute may also be used as an insert to permit machines designed to handle stock material of a certain width to function with material having a reduced width, thus increasing the versatility of a cushion producing machine.

In accordance with one embodiment of the invention, a cushion producing machine includes a frame, a forming assembly mounted to the frame for creating a cushioning product from sheet-like stock material, the forming assembly including a triangular plate coacting with a pair of curved surfaces to inwardly roll the lateral edges of the stock material to form a continuous strip having lateral pillow-like portions and a thin central band, and a gear assembly for engaging the central band of the continuous strip.

In accordance with another aspect of the invention, an assembly for converting a cushion producing machine suitable for producing dunnage product from sheet-like stock material of a certain width to a machine suitable for producing dunnage from a smaller width sheet-like stock material includes a forming assembly insert sized to fit within a larger forming assembly, the insert including a triangular plate coacting with a pair of curved surfaces to inwardly roll the lateral edges of the stock material to form a continuous strip having lateral pillow-like portions and a thin central band.

These and other features of the invention are fully described and particularly pointed out in the claims. The following descriptive annexed drawings set forth in detail one illustrative embodiment, this embodiment being indicative of but one of the various ways in which the principles of the invention may be employed.

DETAILED DESCRIPTION OF THE INVENTION

Figure 1:
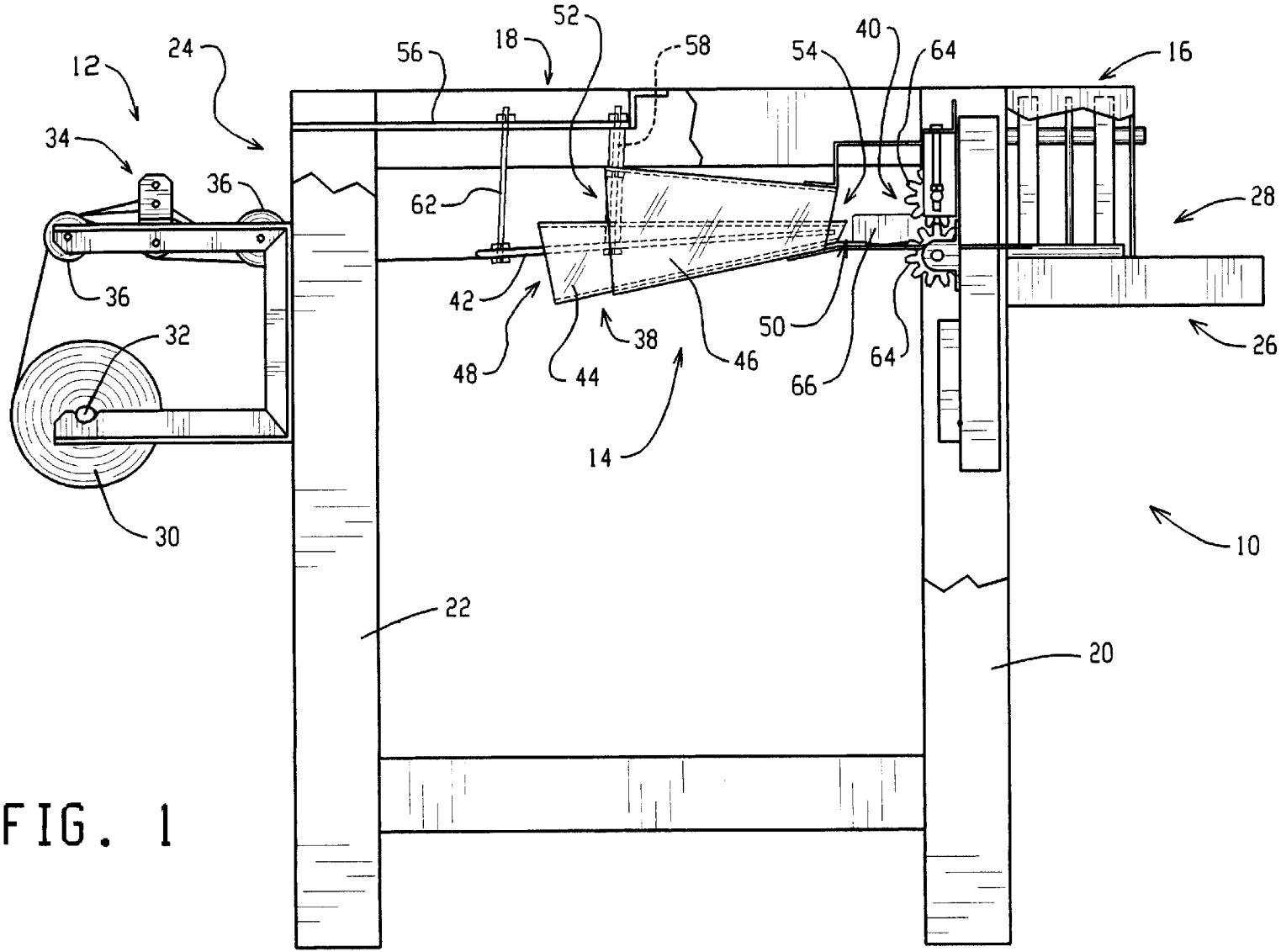
FIG. 1 is an elevation view of a cushion producing machine employing the forming assembly of the present invention.

With reference to the drawings and initially to FIG. 1, there is shown a cushion producing machine 10 including a stock supply assembly 12 for the supply of material to be converting into a cushioning product, a conversion assembly 14 for converting the stock material into a continuous strip of cushioning product and a cutting assembly 16 which cuts the continuous strip of cushioning product into cut pads of a desired length. The stock supply assembly 12, the conversion assembly 14 and the cutting assembly 16 are preferably mounted to or otherwise positioned relative to a frame 18. The frame 18 includes front legs 20 and rear legs 22 positioned near the upstream and downstream ends 24, 26, respectively, of the machine 10 for elevating the output zone 28 of the machine to an appropriate height for discharge of the cut pads into a transitional zone such as for use by an operator or for transport by a conveyor, for example.

The stock supply assembly 12, located at the upstream end 24 of the frame 18, is adapted to accept a multi-ply roll of sheet-like stock material 30, such as, for instance, three ply 30 pound kraft paper sheet. The stock roll 30 includes a hollow core of a generally cylindrical configuration upon which the multiple sheets of the stock material are wound and through which a supporting rod 32 extends to support the roll relative to the frame 18. Material pulled from the roll 30 enters a separating mechanism 34 comprising a series of rollers 36 for separating the plies of sheet-like material prior to the material entering the conversion assembly 14.

Figure 2:
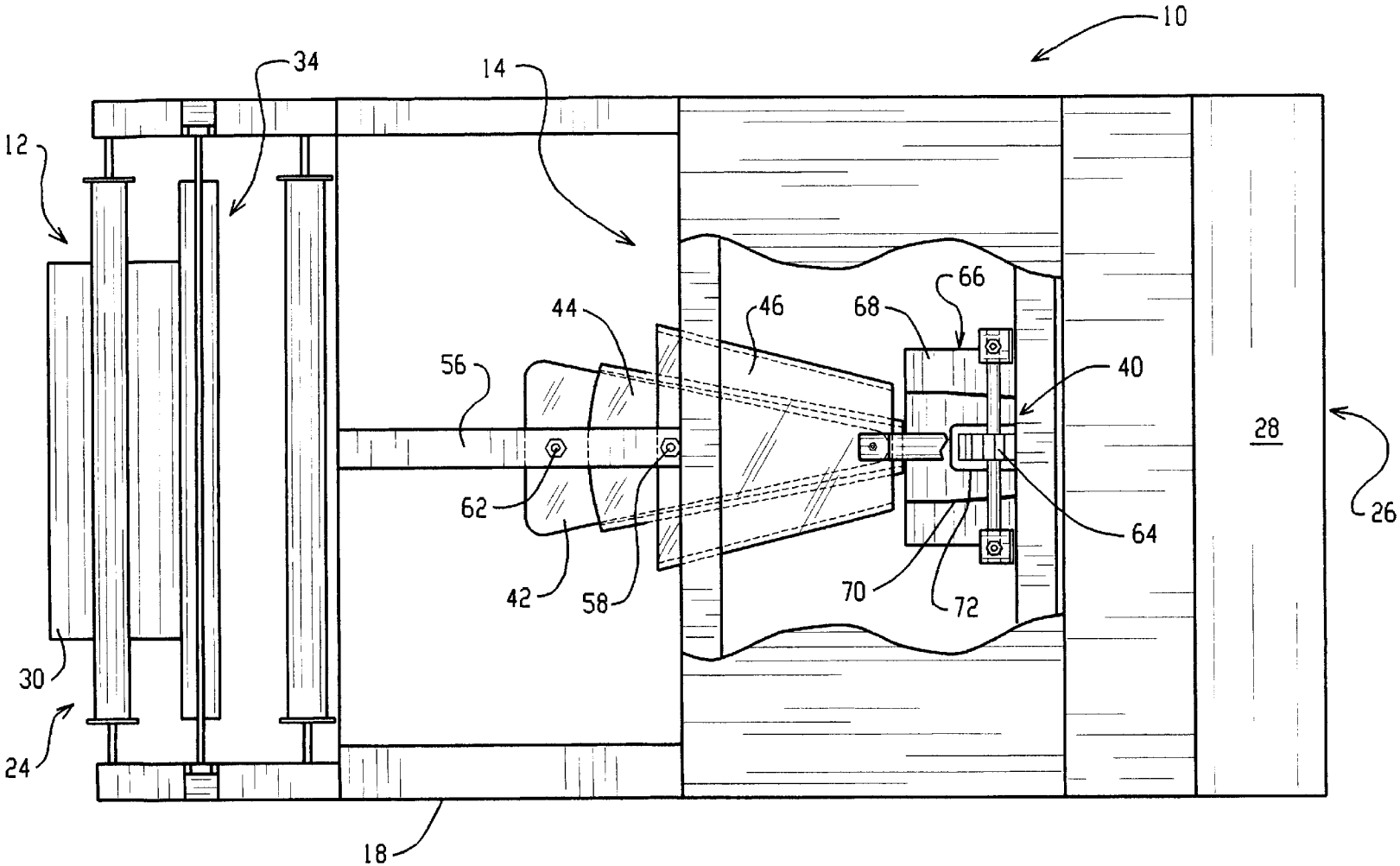
FIG. 2 is a top plan view of the cushion producing machine of FIG. 1.
Figure 3:
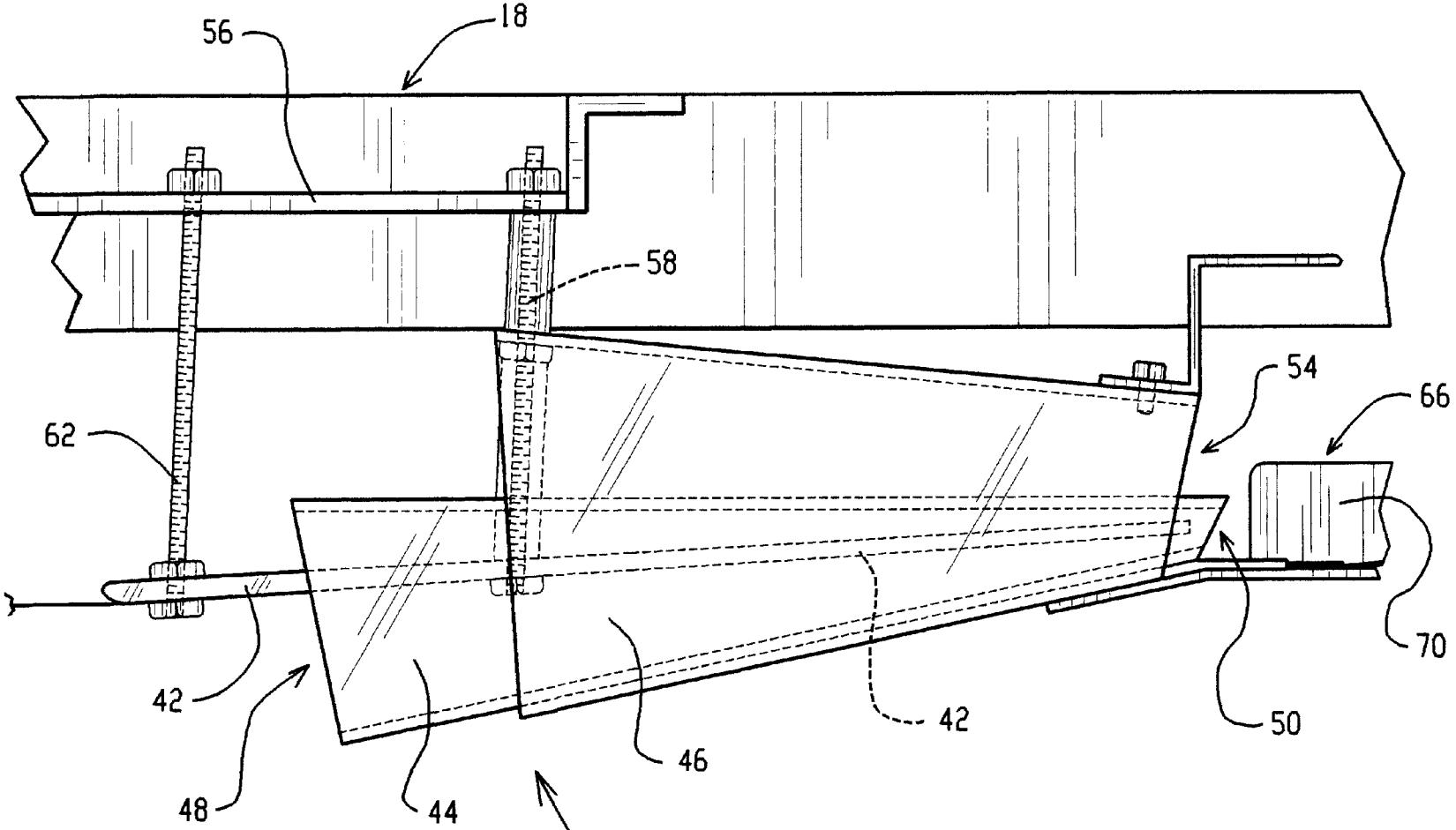
FIG. 3 is a broken and enlarged elevation view of the forming assembly.

The conversion assembly 14, located downstream of the stock supply assembly 12, includes a forming assembly 38 and a gear assembly 40 which coact to convert the sheet-like material into a continuous strip of cushioning product. FIGS. 1 through 3 depict an application of a forming assembly 38 for use in converting narrow width stock material, for example, paper approximately 15 inches wide, to cushioning product employed in a machine which is capable of converting either narrow stock material or full width stock material. As shown in the embodiment of FIGS. 1 through 3, the forming assembly 38 includes a preferably solid triangular shape plate or member 42 at least partially disposed within an inner chute 44, which is in turn at least partially disposed within an outer chute 46. If the machine were to be used with full width stock material, the triangular plate 42 and inner chute 44 would be removed and replaced with a conventional three-dimensional wire forming frame or with an appropriately sized triangular plate in accordance with the invention of this application. In some instances, it may also be desirable that the outer chute 46 be eliminated and the triangular plate 42 and inner chute 44 be used alone to form the forming assembly.

The inner chute 44 has a generally flattened, hollow cone shape with a widened mouth or entranceway 48 opening in the direction of the stock supply assembly 12 with the body of the chute converging toward the gear assembly 40 and terminating in an exit 50. The inner chute 44 is flattened along its vertical plane thus leading to generally oval shape entranceway 48 and exit 50. The triangular plate 42 is situated so as to extend into the inner chute 44 with the base of the triangular plate facing the upstream end 24 of the frame 18, the sides of the triangular plate converging at an equal, slightly greater, or slightly lesser rate than the adjacent curved inner surfaces of the inner chute and the apex of the triangular plate being generally near the exit 50 of the inner chute. Preferably the triangular plate 42 has curved edge surfaces which extend into the bight portion of the curved inner surfaces of the inner chute 44. The triangular plate 42 and the inner chute 44 are preferably made of plastic and more preferably of polycarbonate.

In operation, the sheet-like stock material is fed through the forming assembly 38 with the material placed between the triangular plate 42 and the lower portion of the inner chute 44 and folded over the sides of the triangular plate. The triangular plate 42 and inner chute 44 are sized relative to one another and to the width of the stock material so that the curved inner surfaces of the inner chute and the triangular plate cooperate to cause the lateral edges of the stock material being fed through the forming assembly 38 to roll inwardly, such as in a spiralling fashion, to form a continuous strip having lateral pillow-like portions and a thin central band.

The outer chute 46 has a generally flattened, hollow cone shape with an entranceway 52 and exit 54 similar to the inner chute 44 and is also preferably made of a plastic material, such as polycarbonate. The outer chute 46 is mounted near the entranceway 52 to an upper portion 56 of the frame 18, such as by a threaded rod 58 and is secured near the exit 54 by an attachment to the frame 18. The inner chute 44 rests along the inside bottom of the outer chute 46 and is mounted to the upper portion 56 of the frame 18 also by the rod 58. The triangular plate 42 is maintained in position by a connection at an intermediate point along the plate to the rod 58 which extends through the top portions of both the outer chute 46 and inner chute 44 and at its upstream end, for example, by a connection to a threaded rod 62 extending from the upper portion 56 of the frame 18.

The continuous strip of cushioning material upon leaving the exit 50 of the inner chute 46 is pulled into the gears 64 of the gear assembly 40. An insert adapter 66, which is employed in conjunction with the inner chute 44, adapts the gear assembly portion of the machine to the relatively smaller continuous strip of cushioning product produced from the narrow stock material.

Figure 4:
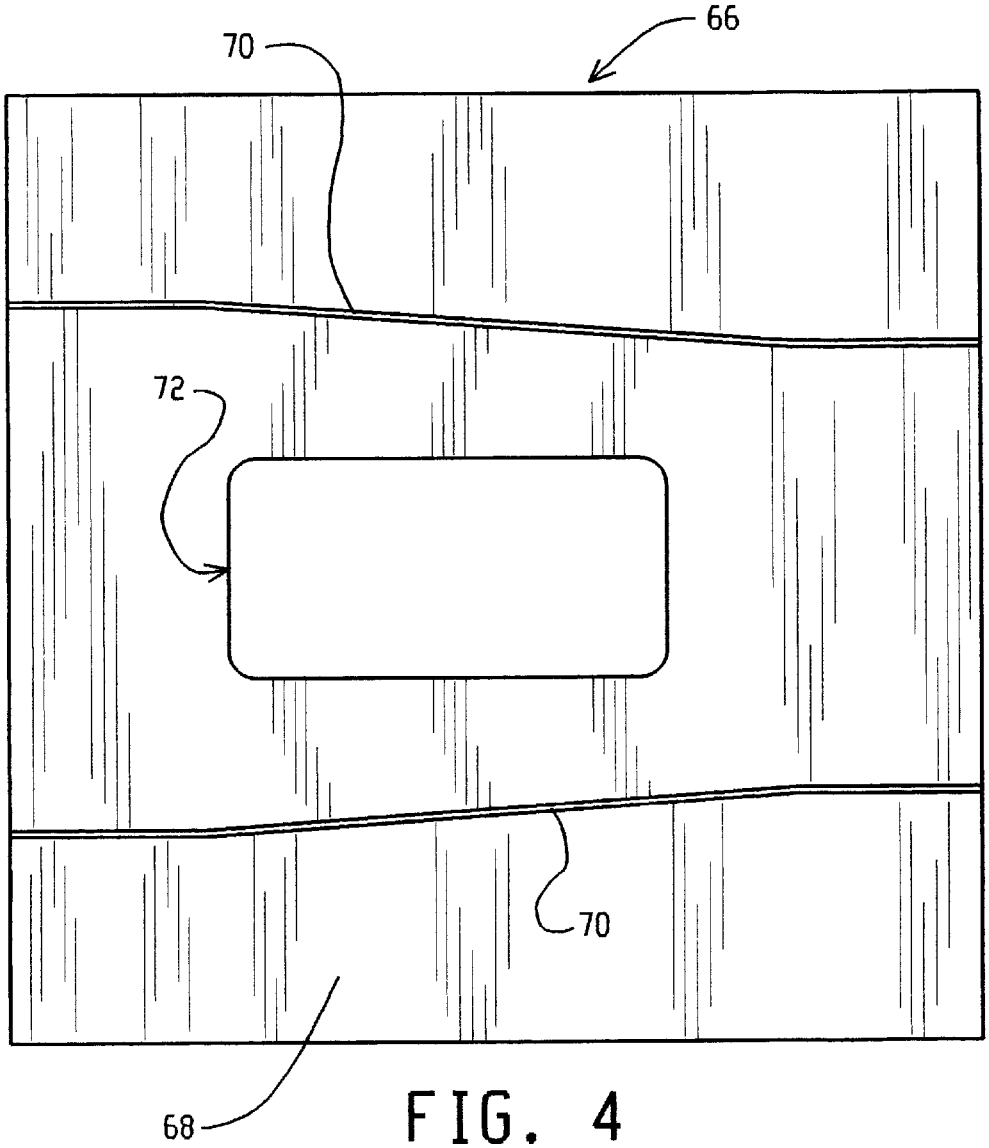
FIG. 4 is an enlarged top plan view of an adapter insert.
Figure 5:
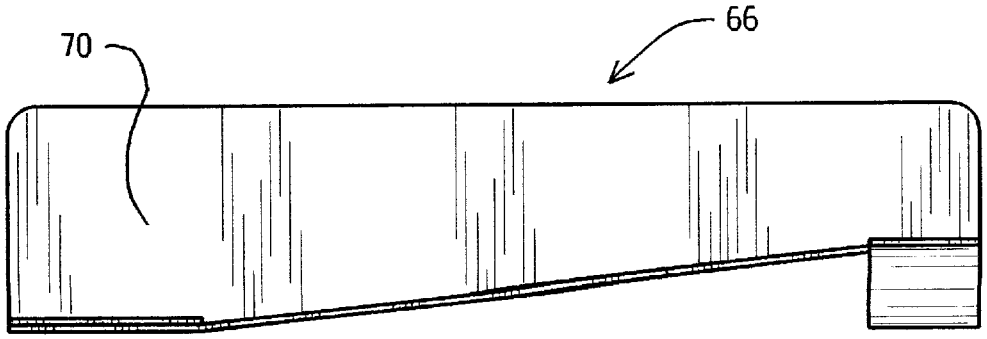
FIG. 5 is an enlarged elevation view of the adapter insert of FIG. 4.

The insert adapter 66, as shown more clearly in FIGS. 4 and 5, includes a base 68 which inclines toward the enmeshed area or nip of the gears 64 of the gear assembly 40 to direct the continuous strip toward the enmeshed gears, upstanding walls 70 which converge away from the exit 50 of the inner chute 44 to center the central band of the strip in the nip of the gears and to constrain the continuous strip, and an opening 72 to accommodate the gears.

The gear assembly 40, as shown in FIGS. 1 and 2, performs a "pulling" function by engaging the continuous strip and drawing it through the nip of two cooperating and opposed gears 64 of the gear assembly thereby drawing stock material from the roll 30 through the forming assembly 38 for a duration suitable to produce a pad of the desired length. The gear assembly 40 additionally performs a "coining" or "connecting" function as the two opposed gears 64 coin at least the central band of the continuous strip as it passes therethrough to form a coined strip. As the coined strip travels downstream from the gear assembly 40, the cutting assembly 16 cuts the strip into sections of a desired length.

The triangular plate 42 and the inner chute 44 may be employed as a kit or a forming assembly insert along with the insert adaptor 66 to convert a cushion producing machine 10 originally adapted for use with full width rolls of stock material into a machine suitable for use with narrower width stock material.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A cushion producing machine, comprising:

a frame;

a forming assembly mounted to the frame for creating a cushioning product from sheet-like stock material, the forming assembly including a triangular plate coacting with a pair of curved surfaces to roll inwardly lateral edges of the stock material to form a continuous strip having lateral pillow-like portions and a thin central stand; and a gear assembly for engaging at least the central band of the continuous strip.

2. The cushion producing machine of claim 1, wherein said triangular plate is solid.

3. The cushion producing machine of claim 1, wherein said triangular plate is constructed of plastic.

4. The cushion producing machine of claim 1, wherein said triangular plate is constructed of polycarbonate.

5. The cushion producing machine of claim 1, including a stock supply assembly which supplies the sheet-like stock material to the forming assembly; and a cutting assembly which cuts the coined strip into pads of a desired length.

6. The cushion producing machine of claim 1, wherein the pair of curved surfaces are part of a generally conical shape hollow body.

7. The cushion producing machine of claim 6, wherein the generally conical shape hollow body is in the shape of a flattened cone.

8. The cushion producing machine of claim 6, wherein the triangular plate is at least partially disposed within the flattened cone.

9. The cushion producing machine of claim 6, wherein the generally conical shape hollow body forms an inner chute.

10. The cushion producing machine of claim 6, wherein the inner chute is disposed within an outer chute.

11. The cushion producing machine of claim 1, wherein the triangular plate has sides which converge toward the gear assembly and the pair of curved surfaces converge toward the gear assembly.

12. The cushion producing machine of claim 1, wherein the gear assembly coins the central band of the continuous strip.

13. The cushion producing machine of claim 1, wherein the triangular plate has curved edge surfaces.

14. The cushion producing machine of claim 1, wherein edges of the triangular plate extend into a bight portion of said pair of curved surfaces.

15. An assembly for converting a cushion producing machine suitable for producing dunnage product from sheet-like stock material of a certain width to a machine suitable for producing dunnage from a smaller width sheet-like stock material, comprising:

a forming assembly insert sized to fit within a larger forming assembly, the insert including a triangular plate coating with a pair of curved surfaces to roll inwardly lateral edges of the stock material to form a continuous strip having lateral pillow-like portions and a thin central band.

16. The assembly of claim 15, wherein said triangular plate is solid.

17. The assembly of claim 15, wherein said triangular plate is constructed of plastic.

18. The assembly of claim 15, wherein said triangular plate is constructed of polycarbonate.

19. The assembly of claim 15, further including an adaptor for channeling the continuous strip to a coining assembly.

20. The assembly of claim 15, wherein the pair of curved surfaces are part of a generally conical shape hollow body.

21. The assembly of claim 20, wherein the generally conical shape hollow body is in the shape of a flattened cone.

22. The assembly of claim 15, wherein the triangular plate has curved edge surfaces.

23. The assembly of claim 15, wherein edges of the triangular plate extend into a bight portion of said pair of curved surfaces.

24. A cushioning conversion machine for converting a sheet-like stock material into a cushioning product, said machine comprising:

a frame, a forming assembly mounted to the frame which forms the sheet-like stock material into a three-dimensional strip having lateral pillow-like portions separated by a central band, and a feed assembly which feeds the sheet-like stock material through the forming assembly;

wherein the forming assembly includes a triangular plate and a member including a pair of curved surfaces which together cause lateral edges of the stock material to roll inwardly to form the three-dimensional strip; and wherein the pair of curved surfaces each include a bight portion and the triangular plate includes a pair of side edges which extend into the bight portions of the curved surfaces.

* * * * *

UNITED STATES PATENT AND TRADEMARK OFFICE

CERTIFICATE OF CORRECTION

PATENT NO. : 6,190,299 B1
DATED : February 20, 2001
INVENTOR(S) : James A. Simmons It is certified that error appears in the above-identified patent and that said Letters Patent is hereby corrected as shown below:

Claim 1,
Line 9 (column 4, line 65), please change "stand" to -- band --.

Signed and Sealed this

Second Day of October, 2001

*Attest:*

Nicholas P. Godici

NICHOLAS P. GODICI
*Acting Director of the United States Patent and Trademark Office*

*Attesting Officer*